US009027658B2

(12) United States Patent
Bories et al.

(10) Patent No.: US 9,027,658 B2
(45) Date of Patent: May 12, 2015

(54) SYSTEM AND METHOD FOR CASING HANGER RUNNING

(75) Inventors: Sebastien Bories, Maleville (FR); Gavin Paul Robottom, Leeds (GB)

(73) Assignee: Cameron International Corporation, Houston, TX (US)

( * ) Notice: Subject to any disclaimer, the term of this patent is extended or adjusted under 35 U.S.C. 154(b) by 432 days.

(21) Appl. No.: 13/504,933

(22) PCT Filed: Mar. 9, 2012

(86) PCT No.: PCT/US2012/028433

§ 371 (c)(1), (2), (4) Date: Apr. 27, 2012

(87) PCT Pub. No.: WO2012/148579

PCT Pub. Date: Nov. 1, 2012

(65) Prior Publication Data

US 2012/0305269 A1 Dec. 6, 2012

(30) Foreign Application Priority Data

Apr. 29, 2011 (EP) ..... 11305516

(51) Int. Cl.
*E21B 23/01* (2006.01)
*E21B 33/04* (2006.01)
*E21B 33/043* (2006.01)

(52) U.S. Cl.
CPC ..... *E21B 33/0415* (2013.01); *E21B 23/01* (2013.01); *E21B 33/043* (2013.01)

(58) Field of Classification Search
CPC ..... E21B 23/01
USPC ..... 166/382, 208, 379, 89.3
See application file for complete search history.

(56) References Cited

U.S. PATENT DOCUMENTS

| | | | | | |
|---|---|---|---|---|---|
| 2,337,733 | A | * | 12/1943 | Burns et al. | 166/124 |
| 3,688,841 | A | | 9/1972 | Baugh | |
| 3,885,625 | A | * | 5/1975 | Ahlstone | 166/181 |
| 4,067,388 | A | * | 1/1978 | Mouret et al. | 166/208 |
| 4,488,740 | A | | 12/1984 | Baugh et al. | |
| 4,497,371 | A | * | 2/1985 | Lindsey, Jr. | 166/377 |
| 4,615,544 | A | | 10/1986 | Baugh | |
| 4,757,860 | A | | 7/1988 | Reimert | |
| 4,979,566 | A | | 12/1990 | Hosie et al. | |
| 2008/0257560 | A1 | * | 10/2008 | Brisco et al. | 166/377 |

FOREIGN PATENT DOCUMENTS

WO 2010096218 A1 8/2010

OTHER PUBLICATIONS

European Search Report for Application No. EP 11305516 dated Aug. 17, 2011.

* cited by examiner

*Primary Examiner* — Cathleen Hutchins
(74) *Attorney, Agent, or Firm* — Fletcher Yoder P.C.

(57) ABSTRACT

In certain embodiments, a hanger running tool includes an inner sleeve and an outer sleeve. The inner sleeve has a first mating surface configured to engage a second mating surface of a hanger to couple the inner sleeve to the hanger. The outer sleeve is disposed about the inner sleeve. The outer sleeve is configured to rotate about a common longitudinal axis with respect to the inner sleeve.

27 Claims, 11 Drawing Sheets

SYSTEM AND METHOD FOR CASING HANGER RUNNING

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

As will be appreciated, oil and natural gas have a profound effect on modern economies and societies. Indeed, devices and systems that depend on oil and natural gas are ubiquitous. For instance, oil and natural gas are used for fuel in a wide variety of vehicles, such as cars, airplanes, boats, and the like. Further, oil and natural gas are frequently used to heat homes during winter, to generate electricity, and to manufacture an astonishing array of everyday products.

In order to meet the demand for such natural resources, companies often invest significant amounts of time and money in searching for and extracting oil, natural gas, and other subterranean resources from the earth. Particularly, once a desired resource is discovered below the surface of the earth, drilling and production systems are often employed to access and extract the resource. These systems may be located onshore or offshore, depending on the location of a desired resource. Further, such systems generally include a wellhead assembly through which the resource is extracted. These wellhead assemblies may include a wide variety of components, such as various casings, hangers, valves, fluid conduits, and the like, that control drilling and/or extraction operations. In some drilling and production systems, hangers, such as a casing hanger, may be used to suspend strings (e.g., piping for various flows in and out) of the well. Such hangers may be disposed within a housing of a wellhead, which supports both the hanger and the string.

BRIEF DESCRIPTION OF THE DRAWINGS

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

Figure 1:
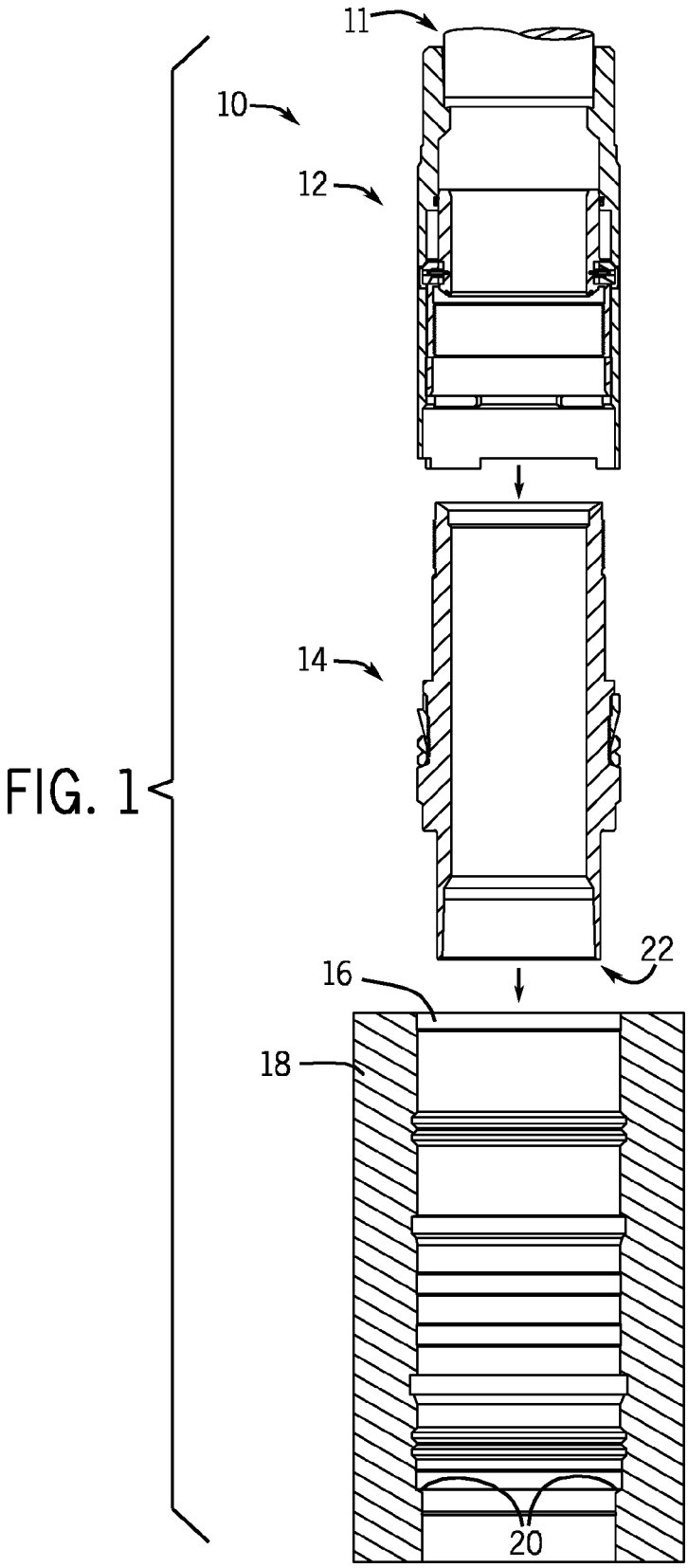
FIG. 1 is an exploded cross-sectional view of an example of a hanger installation system in accordance with certain embodiments of the present technique.

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Moreover, the use of "top," "bottom," "above," "below," and variations of these terms is made for convenience, but does not require any particular orientation of the components.

As described above, hangers (e.g., casing hangers) may be used to suspend strings (e.g., piping for various flows in and out) of the well. Such hangers may be disposed within a housing of a wellhead, which supports both the hanger and the string. For example, as described below, a casing hanger may be lowered into a housing by a casing string. During the running or lowering process, the casing hanger may be latched to a casing hanger running tool (CHRT), thereby coupling the casing hanger to the casing string. Once the casing hanger has been lowered into a landed position within the housing, the casing hanger may be permanently locked into position. The CHRT may then be unlatched from the casing hanger and extracted from the wellhead by the casing string.

In certain configurations, the processes of running the casing hanger and locking the casing hanger to the housing may be performed by separate tools which can be run at the same time or run in sequential trips. Unfortunately, utilizing separate tools for running the casing hanger and locking the casing hanger may be costly and time consuming. For example, when the two tools are run at the same time, the blow out preventer sealing may become corrupted and two rotational control systems may be required at the same time at the surface. However, when the two tools are run sequentially, there may be an extended time period where the wellhead is not locked and multiple trips would be required, increasing installation time and cost.

Certain exemplary embodiments of the present technique include a system and method that addresses one or more of the above-mentioned challenges of installing a casing hanger. As described in greater detail below, the disclosed embodiments include a hanger running tool having an inner sleeve and an outer sleeve. The inner sleeve has a first mating surface configured to engage a second mating surface of a hanger to couple the inner sleeve to the hanger. The outer sleeve is disposed about the inner sleeve. In order to install the casing hanger, the inner sleeve of a hanger running tool is attached to the casing hanger. The casing hanger is then lowered into a casing housing utilizing the hanger running tool. Next, the casing hanger is locked to the casing housing by utilizing the hanger running tool to energize an energizing ring via rotation of the outer sleeve of the hanger running tool about a common longitudinal axis with respect to the inner sleeve of the hanger running tool. Then, the casing hanger is detached from the inner sleeve of the hanger running tool, and the hanger running tool is retrieved.

FIG. 1 is an exploded cross-sectional view of an example of a hanger installation system 10 in accordance with certain embodiments of the present technique. In the illustrated embodiment, the hanger installation system 10 includes a casing string 11 that is attached to a casing hanger running tool 12 and is capable of lowering the casing hanger running tool 12 from an offshore vessel to the well and/or wellhead. The casing hanger running tool 12 enables a casing hanger 14 to be installed in one trip with one tool. In certain embodiments, the casing string 11 may be attached to the casing hanger running tool 12 via threading or any other suitable attachment fastener or coupling. The hanger installation system 10 also includes a casing hanger 14, and a spool or housing 16, which may be installed at the ground surface 18. The casing hanger 14 comprises a portion of a wellhead assembly, which provides support for the casing string 11.

As described in greater detail below, the casing hanger running tool 12 is configured to couple with the casing hanger 14. When coupled to the casing hanger 14, the casing hanger running tool 12 is capable of running the casing hanger 14 into the housing 16. The casing hanger 14 is designed to support the full weight of the casing, when the casing hanger 14 is installed into the casing housing 16. The housing 16 serves as a primary landing spot for the casing hanger 14. In particular, the housing 16 includes a landing shoulder 20 that is configured to receive a bottom portion 22 of the casing hanger 14. Once the casing hanger 14 is inserted into the housing 16, the casing hanger running tool 12 locks the casing hanger 14 into place with respect to the housing 16. The casing hanger running tool 12 is then decoupled from the casing hanger 14 and retrieved from the housing 16.

Figure 2:
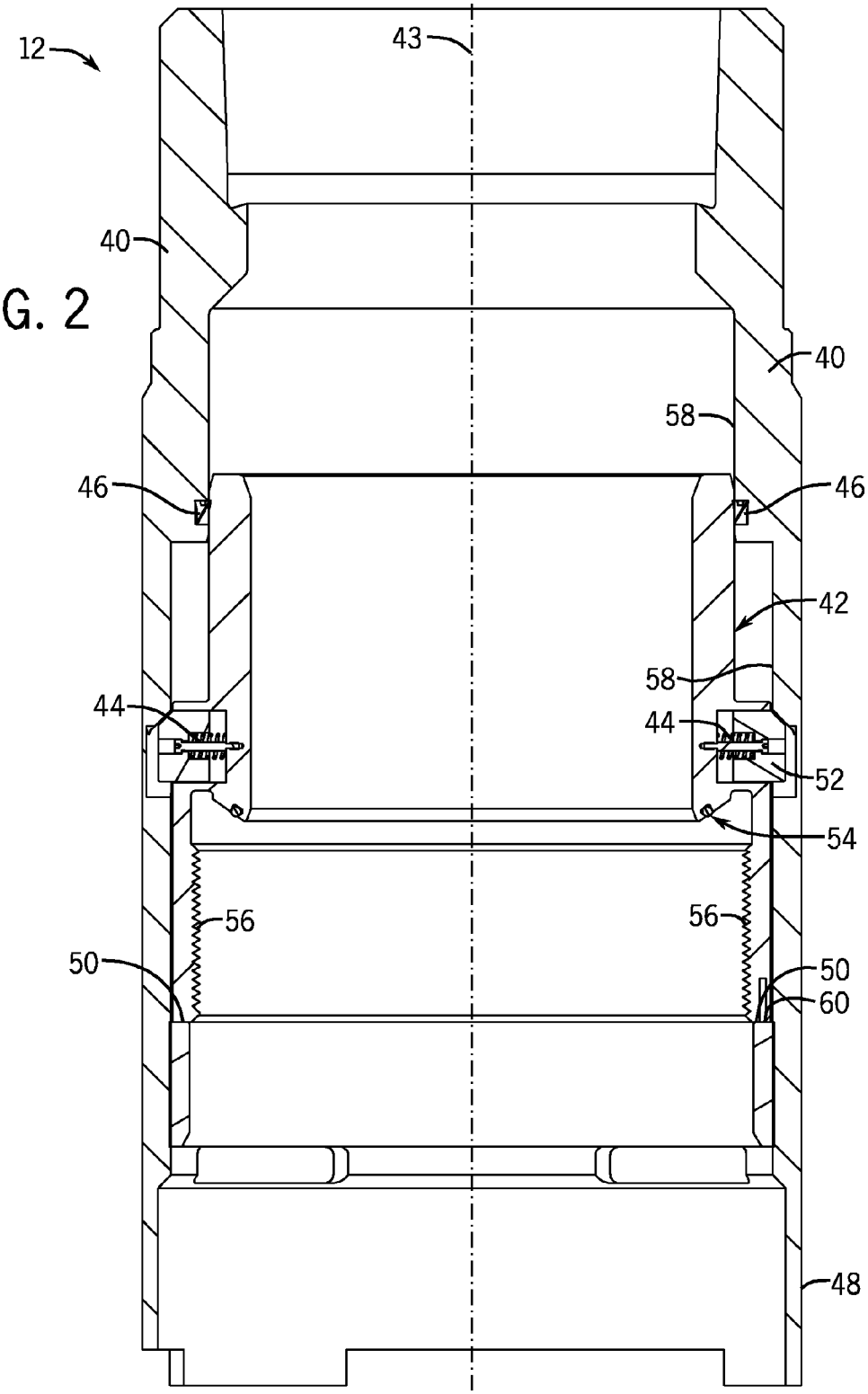
FIG. 2 is a cross-sectional view of an example of the casing hanger running tool in accordance with certain embodiments of the present technique.

FIG. 2 is a cross-sectional view of an example of the casing hanger running tool 12 that enables a hanger installation with a single tool and a single trip, in accordance with certain embodiments of the present technique. The casing hanger running tool 12 includes an outer sleeve 40 and an inner sleeve 42. The outer sleeve 40 is independently rotatable about a common longitudinal axis 43 with respect to the inner sleeve 42. Additionally, the outer sleeve 40 is configured to slide vertically along the common longitudinal axis 43 with respect to the inner sleeve 42. The outer sleeve 40 is configured with one or more spring energized dog pockets 44, squeezed lip seals 46, sleeve castellations 48, and a bearing shoulder 50. The inner sleeve 42 includes one or more spring energized dogs 52, an o-ring face seal 54, and hanger running threads 56.

As described in greater detail below, the spring energized dog pockets 44 of the outer sleeve 40 are recessed areas located circumferentially around an inner surface 58 of the outer sleeve 40. The spring energized dog pockets 44 are configured to receive respective spring energized dogs 52 of the inner sleeve 42 when the spring energized dog pockets 44 are axially and circumferentially aligned with the spring energized dogs 52 about the common longitudinal axis 43. Prior to axial and circumferential alignment of the spring energized dog pockets 44 of the outer sleeve 40 and the spring energized dogs 52 of the inner sleeve 42, the outer sleeve 40 is capable of rotating about the common longitudinal axis 43 with respect to the inner sleeve 42 and sliding (i.e., translating) along the common longitudinal axis 43 with respect to the inner sleeve 42. However, once the spring energized dogs 52 move radially outward and are received into the spring energized dog pockets 44, rotation of the outer sleeve 40 drives rotation of the inner sleeve 42. In one particular embodiment, the outer sleeve 40 includes four spring energized dog pockets 44, and thus the inner sleeve 42 includes four respective spring energized dogs 52. In other embodiments, the number of spring energized dog pockets 44 and spring energized dogs 52 may vary. For example, the outer and inner sleeves 40, 42 may include 1, 2, 3, 5, 6, or more spring energized dog pockets 44 and spring energized dogs 52, respectively.

The squeezed lip seals 46 act as a seal between the outer sleeve 40 and the inner sleeve 42. In certain embodiments, the squeezed lip seal 46 may consist of a rubber o-ring seal that surrounds the inner sleeve 42 and fits within a recessed slot in the inner surface 58 of the outer sleeve 40. As will be described in more detail below, a mating surface on the outer sleeve 40 (e.g., the sleeve castellations 48) is configured to mate with a mating surface (e.g., complimentary castellations) of an energizing ring associated with the casing hanger 14.

The bearing shoulder 50 of the outer sleeve 40 is configured to mate with a lower mating edge 60 of the inner sleeve 42 when the outer sleeve 40 is in the maximum axial position (or vertical height) with respect to the inner sleeve 42. In other words, after the energizing ring has been energized to lock the casing hanger 14 into place with respect to the housing 16, the outer sleeve 40 may be pulled upward vertically until the bearing shoulder 50 of the outer sleeve 40 abuts the lower mating edge 60 of the inner sleeve 40. At this point, the outer sleeve 40 is at its maximum axial position with respect to the inner sleeve 42. When the outer sleeve 40 is in the maximum vertical position with respect to the inner sleeve 42, the spring energized dog pockets 44 and the spring energized dogs 52 are positioned at a common axial position (or vertical height) along the common longitudinal axis 43.

The o-ring face sealing 54 seals the connection between the casing hanger tool 12 and an attached casing hanger 14. A hanger running tool mating surface (e.g. threaded surface 56) is configured to engage with a mating surface (e.g., threads) on the casing hanger 14, to couple the inner sleeve 42 of the casing hanger 14 to the casing hanger tool 12.

Figure 3:
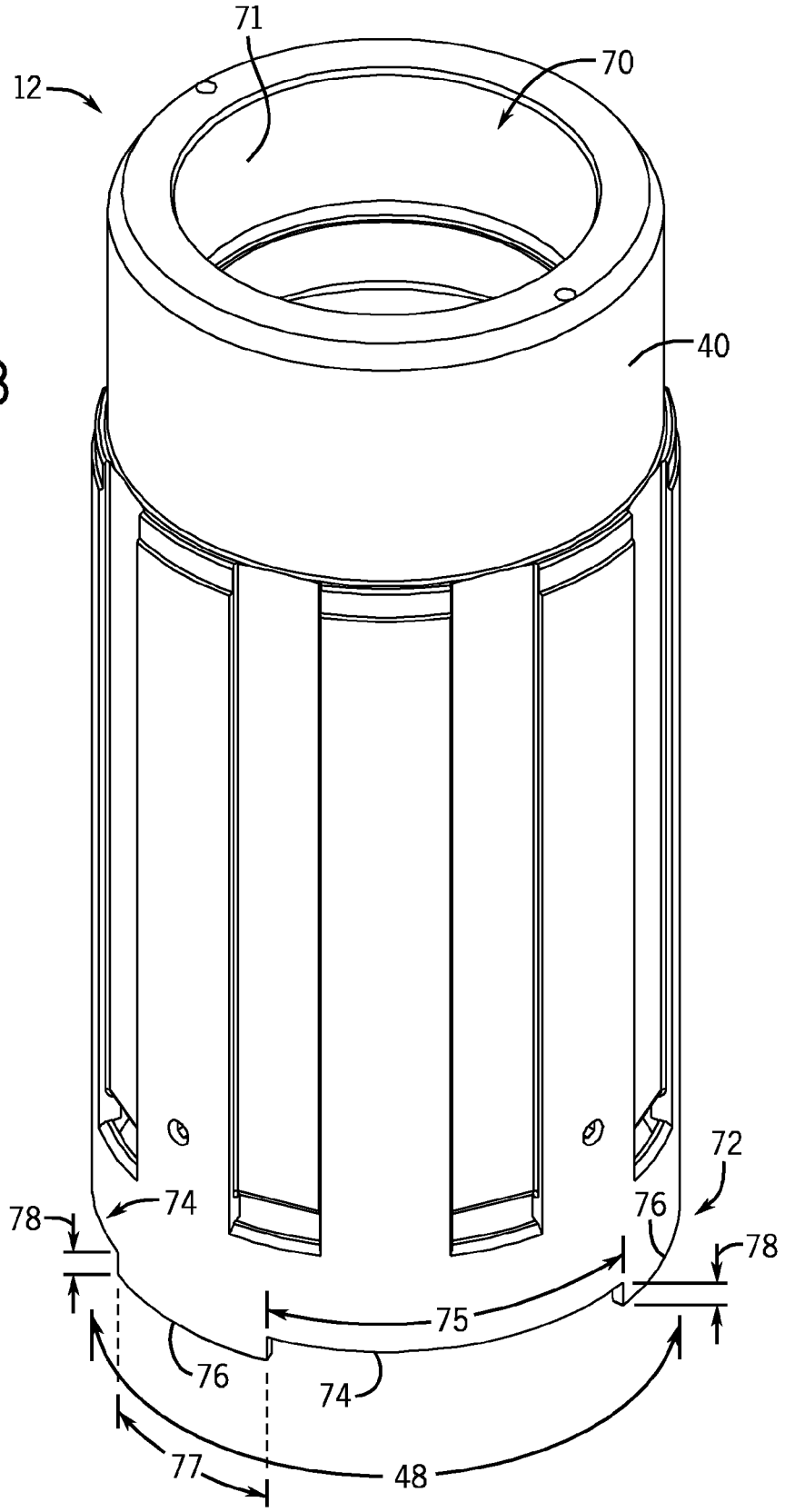
FIG. 3 is a perspective view of the casing hanger running tool of FIG. 2.

FIG. 3 is a perspective view of the casing hanger running tool 12 of FIG. 2. As illustrated, the casing hanger running tool 12 includes a casing string joint receptacle 70 that is a generally annular cross section that is configured to receive the casing string 11 (as discussed above). The casing string joint receptacle 70 is configured to connect to a joint of the casing string 11 via threads on an inner surface 71 of the casing string joint receptacle 70. More specifically, the threads on the inner surface 71 of the casing string joint receptacle 70 are configured to engage mating threads on an outer surface of the joint of the casing string 11.

As described above, the outer sleeve 40 includes sleeve castellations 48 at the bottom edge 72 of the casing hanger running tool 12. The sleeve castellations 48 includes one or more alternating indention edges 74 of width 75 and one or more alternating protrusion edges 76 of width 77. For example, the protrusion edges 76 may have a height 78 of approximately 1.50". The indention edges 74 and the protrusion edges 76 may have substantially similar widths 75, 77. Additionally, in the illustrated embodiment, the castellations 48 are configured with rectangular raised edges. However, in other embodiments, the castellations 48 may be configured with different shapes (e.g., rounded or triangular edges). As described in greater detail below, when properly aligned with castellations on a casing hanger energizing ring, the indention edges 74 of the casing hanger running tool 12 will abut protrusion edges of the energizing ring castellations and the protrusion edges 76 will abut indention edges of the energizing ring castellations. As such, the castellations 48 of the casing hanger running tool 12 circumferentially mate with the castellations of the energizing ring, such that rotation of the casing hanger running tool 12 causes rotation of the energizing ring.

Figure 4:
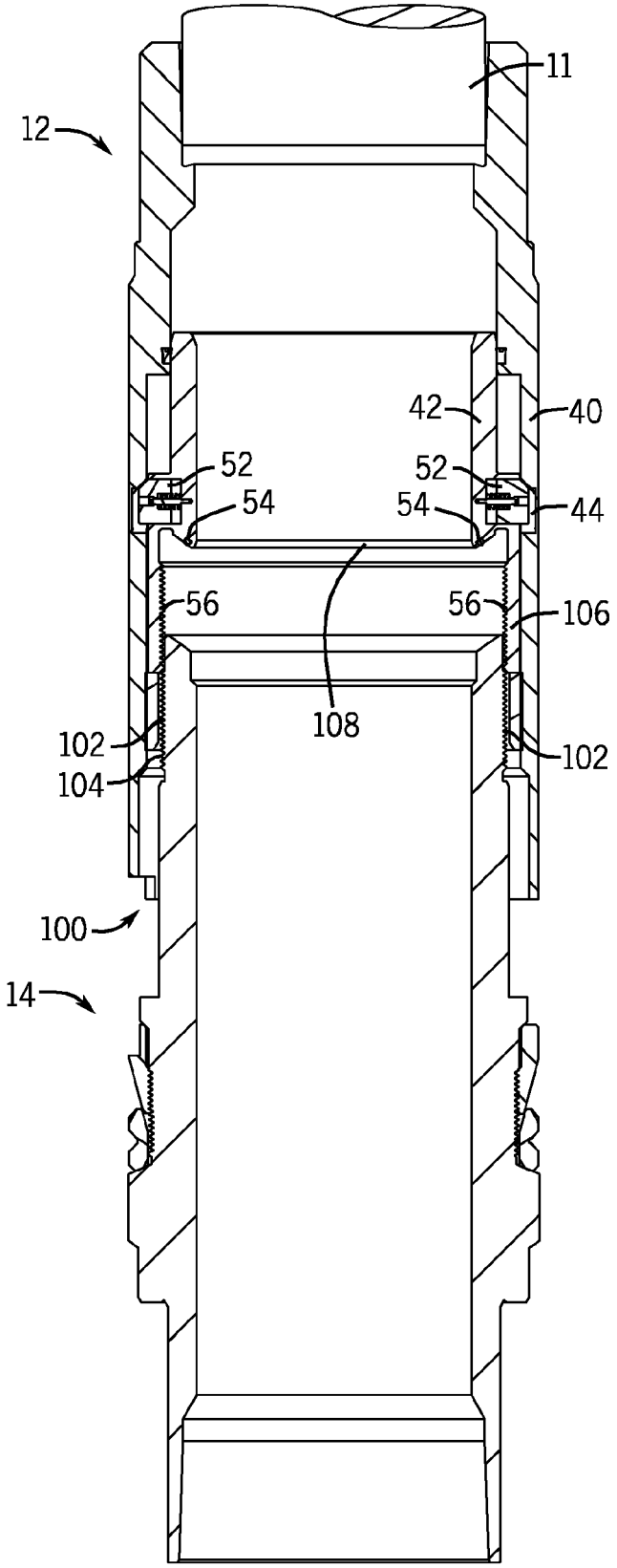
FIG. 4 is a cross-sectional view illustrating the casing hanger running tool coupled to a casing hanger.

FIGS. 4-10 illustrate the progression that occurs during installation of the casing hanger 14 using the casing hanger running tool 12 of FIG. 2. Turning first to FIG. 4, the casing hanger running tool 12 is coupled to the casing hanger 14. The casing hanger 14 is inserted through a bottom opening 100 of the casing hanger running tool 12 until threads 102 on an outer surface 104 of the casing hanger 14 engage threads 56 on an inner surface 106 of the inner sleeve 42 of the casing hanger running tool 12. The casing hanger running tool 14 is then rotated to couple the threads 56 of the inner sleeve 42 of the casing hanger running tool 12 with the threads 102 of the casing hanger 14. It should be noted that at this point, the spring energized dogs 52 of the inner sleeve 42 are engaged with the spring energized dog pockets 44 of the outer sleeve 40, such that rotation of the casing string 11 and the outer sleeve 40 of the casing hanger running tool 12 causes rotation of the inner sleeve 42 of the casing hanger running tool 12, thus facilitating the coupling of the threads 56 of the inner sleeve 42 of the casing hanger running tool 12 with the threads 102 of the casing hanger 14. As previously discussed, the o-ring face sealing 54 of FIG. 2 seals the connection between the casing hanger tool 12 and the attached casing hanger 14. More specifically, as the casing hanger 14 is threaded onto the casing hanger tool 12, a coupling face 108 of the casing hanger 14 comes into contact with the o-ring face sealing 54, thereby creating a sealed interface.

Figure 5:
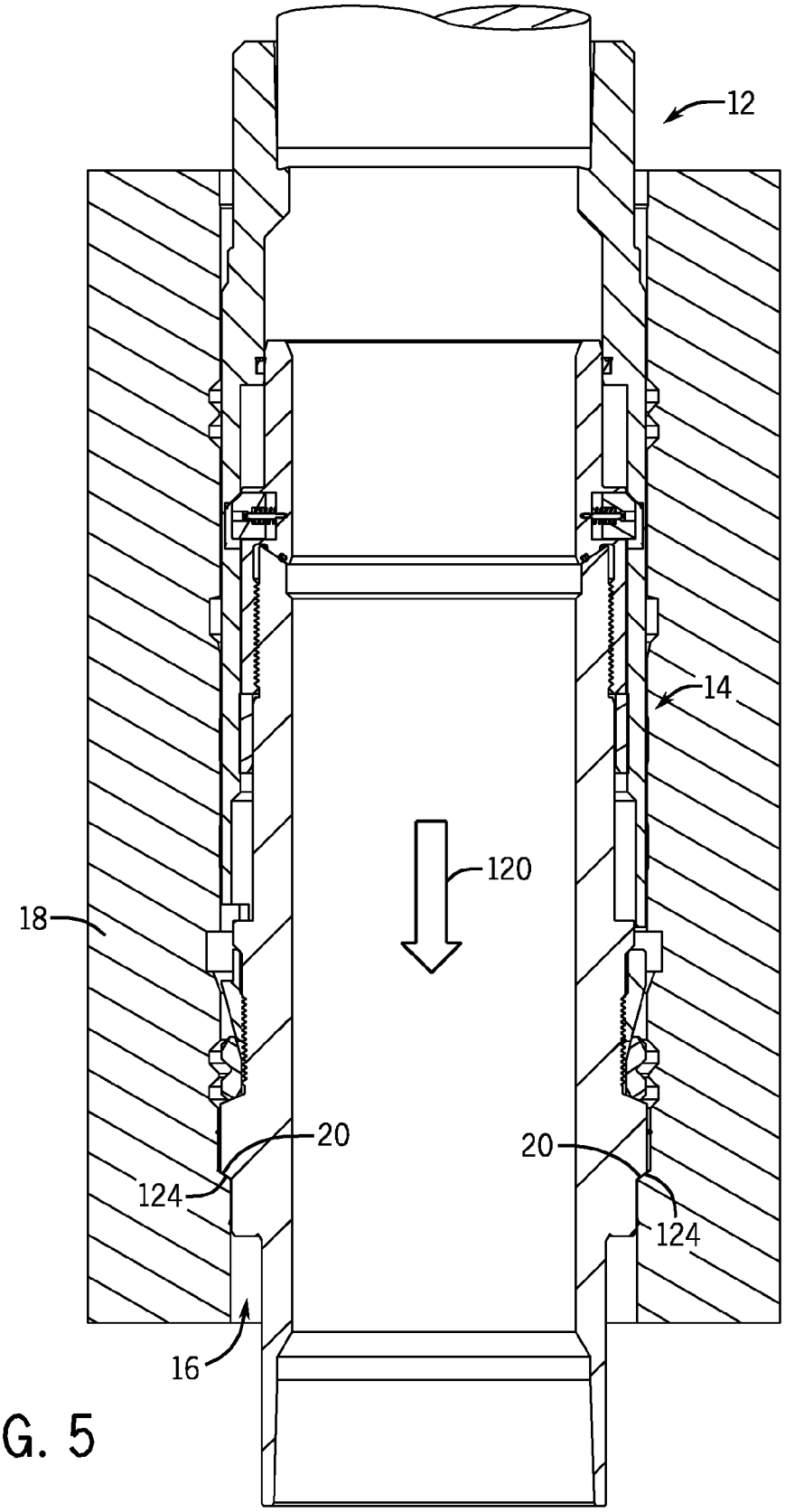
FIG. 5 is a cross-sectional view of the casing hanger inserted into a casing housing by utilizing the casing hanger running tool of FIG. 2.

As depicted in FIG. 5, after securing the casing hanger 14 to the casing hanger running tool 12, the casing hanger running tool 12 and casing hanger 14 are lowered into the casing housing 16, as illustrated by arrow 120. The casing housing 16 may be installed at the ground surface 18. As described above, the housing 16 includes the landing shoulder 20, which receives a complimentary landing zone 124 of the casing hanger 14. Once the landing shoulder 122 and landing zone 124 abut, the lowering operation 120 is halted.

Figure 6:
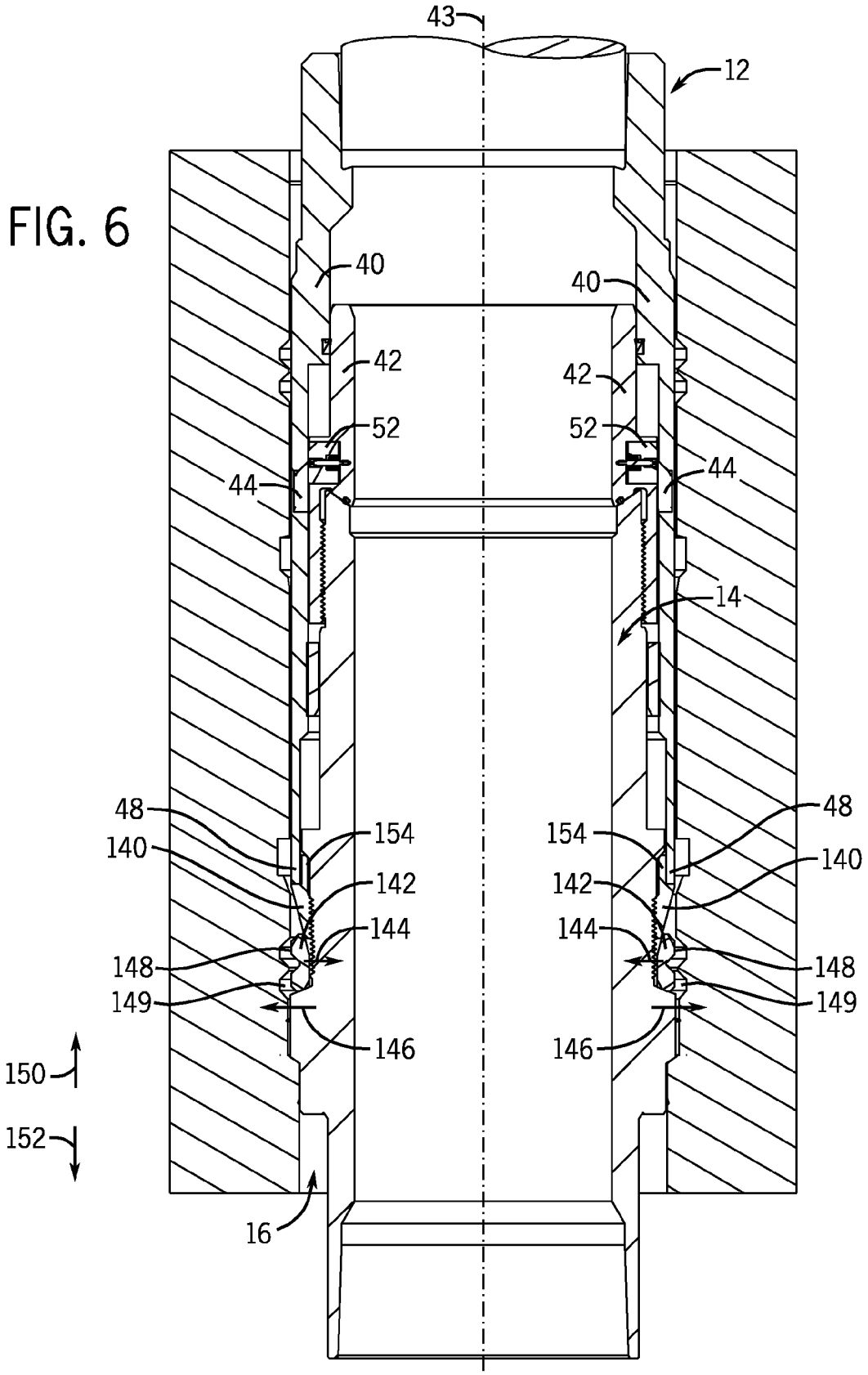
FIG. 6 is a cross-sectional view illustrating the outer sleeve of the casing hanger running tool engaged with an energizing ring of the casing hanger.

As depicted in FIG. 6, the casing hanger 14 includes an energizing ring 140 and a locking ring 142 that is initially retracted, or inwardly biased 144 toward the casing hanger 14 (e.g., radially toward axis 43). When set, or outwardly biased 146 away from the casing hanger 14 (e.g., radially away from axis 43), the locking ring 142 expands into a locking ring receptacle 148 on an inner surface 149 of the casing housing 16, blocking movement of the casing hanger 14 with respect to the casing housing 16 in the upward 150 and downward 152 directions (e.g. opposite axial directions 150 and 152). To set the locking ring 142, the outer sleeve castellations 48 of the casing hanger tool 14 are engaged, or mated, with the energizing ring castellations 154, as shown in FIG. 6. Once the casing hanger 14 is landed in the casing housing 16, the spring energized dogs 52 of the inner sleeve 42 of the casing hanger running tool 12 are retracted from within the spring energized dog pockets 44 of the outer sleeve 40 of the casing hanger running tool 12. As such, the outer sleeve 40 becomes free to rotate and translate along the common longitudinal axis 43 with respect to the inner sleeve 42. The outer sleeve 40 is lowered until the castellations 48 of the outer sleeve 40 engage the castellations 154 of the energizing ring 140. At this point, the indention edges 74 of the casing hanger running tool 12 abut the protrusion edges of the energizing ring castellations 154 and the protrusions edges 76 abut the lower indention edges of the energizing ring castellations 154.

Figure 7:
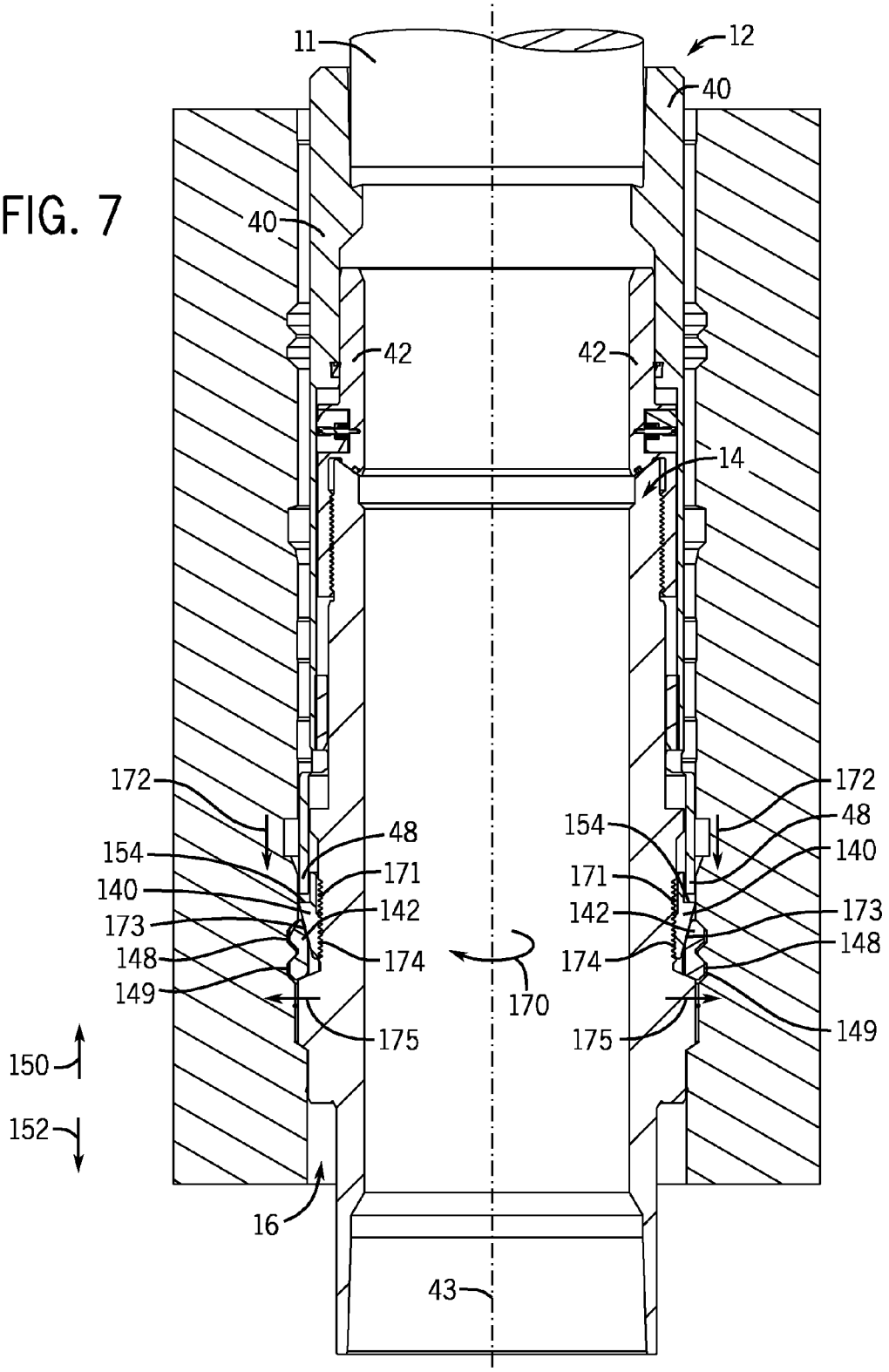
FIG. 7 is a cross-sectional view illustrating the engaged outer sleeve being rotated to screw in the energizing ring and set a locking ring.

Now turning to FIG. 7, once the castellations 48 are mated with the energizing ring castellations 154, the outer sleeve 40 of the casing hanger running tool 12 is rotated about the common longitudinal axis 43 with respect to the inner sleeve 42 of the casing hanger running tool 12 to energize the energizing ring 140, as illustrated by arrow 170. As the outer sleeve 40 is rotated about axis 43, the mating of the castellations 48, 154 of the outer sleeve 40 and the energizing ring 140 causes the energizing ring 140 to rotate with respect to the casing hanger 14. Threading 171 between the energizing ring 140 and the casing hanger 14 causes the energizing ring 140 to be threaded downwardly (e.g., along axis 43) with respect to the casing hanger 14, as illustrated by arrows 172. As the energizing ring 140 is screwed downwardly with respect to the casing hanger 14, an angled outer face 173 of the energizing ring 140 exerts axial pressure on a mating angled inner face 174 of the locking ring 142. Because of the angled nature of the abutting faces 173, 174, the axial movement of the energizing ring 140 also exerts outward radial pressure on the locking ring 142, causing the locking ring 142 to expand outwardly, or set, into the locking ring receptacle 148 on the inner surface 149 of the casing housing 16, as illustrated by arrow 175. Once set, the locking ring 142 blocks movement of the casing hanger in the upward 150 and downward 152 directions (e.g., opposite axial directions 150 and 152).

Figure 8:
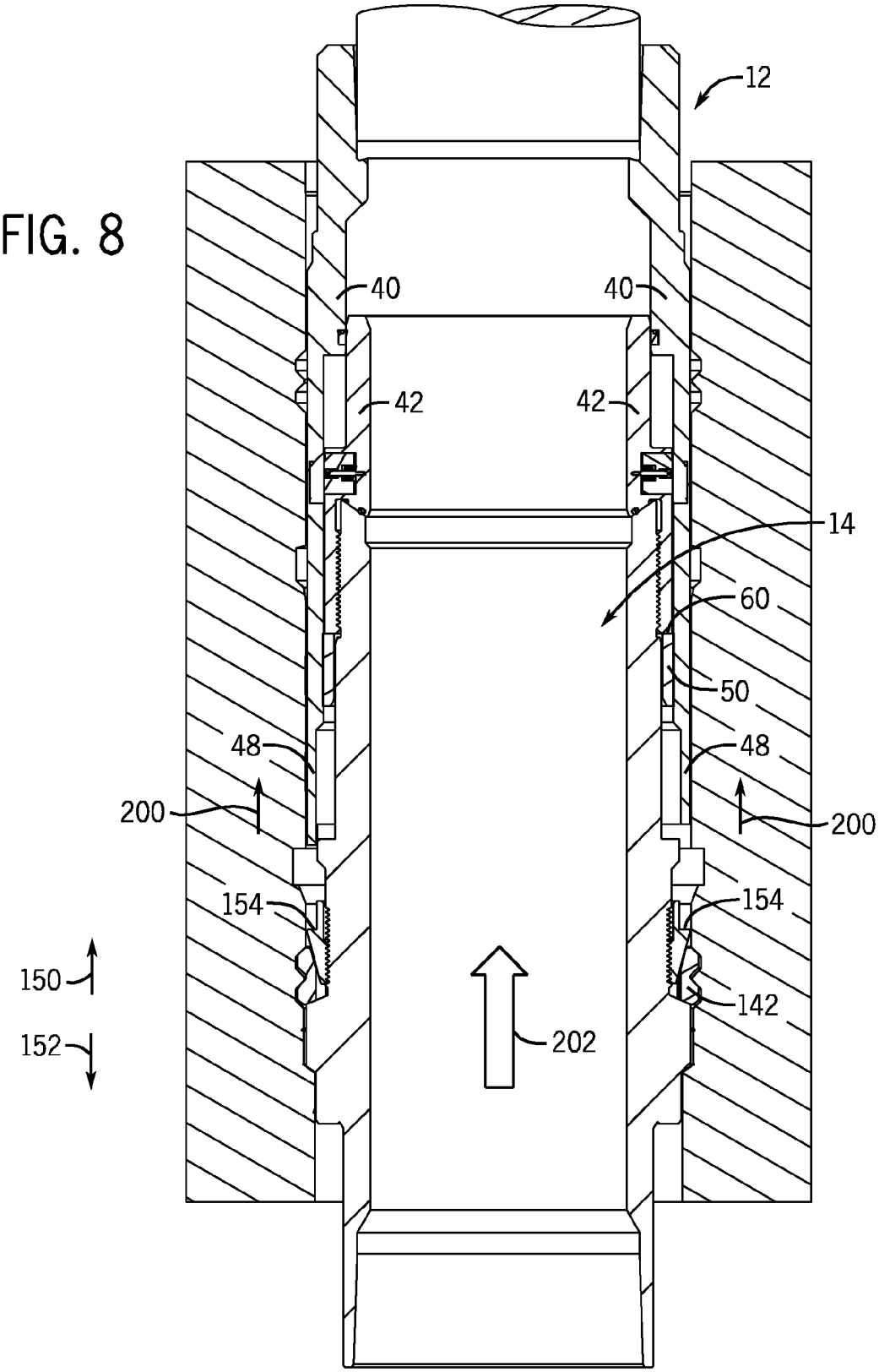
FIG. 8 is a cross-sectional view illustrating the outer sleeve of the casing hanger running tool being disengaged from the energizing ring, and an overpull test being performed on the casing hanger.

Next, as illustrated in FIG. 8, the outer sleeve castellations 48 are disengaged, or lifted from the engagement with the energizing ring castellation 154, as illustrated by arrows 200. At this point, an overpull test may be conducted to test whether the casing hanger 14 is properly set by the locking ring 142. To conduct the overpull test, as illustrated by arrow 202, an upward axial force is exerted on the casing hanger 14, to test for upward 150 and downward 152 movements (e.g., opposite axial movements). If upward 150 or downward 152 movements are detected, the casing hanger 14 is re-landed and the locking procedure described above is repeated.

Figure 9:
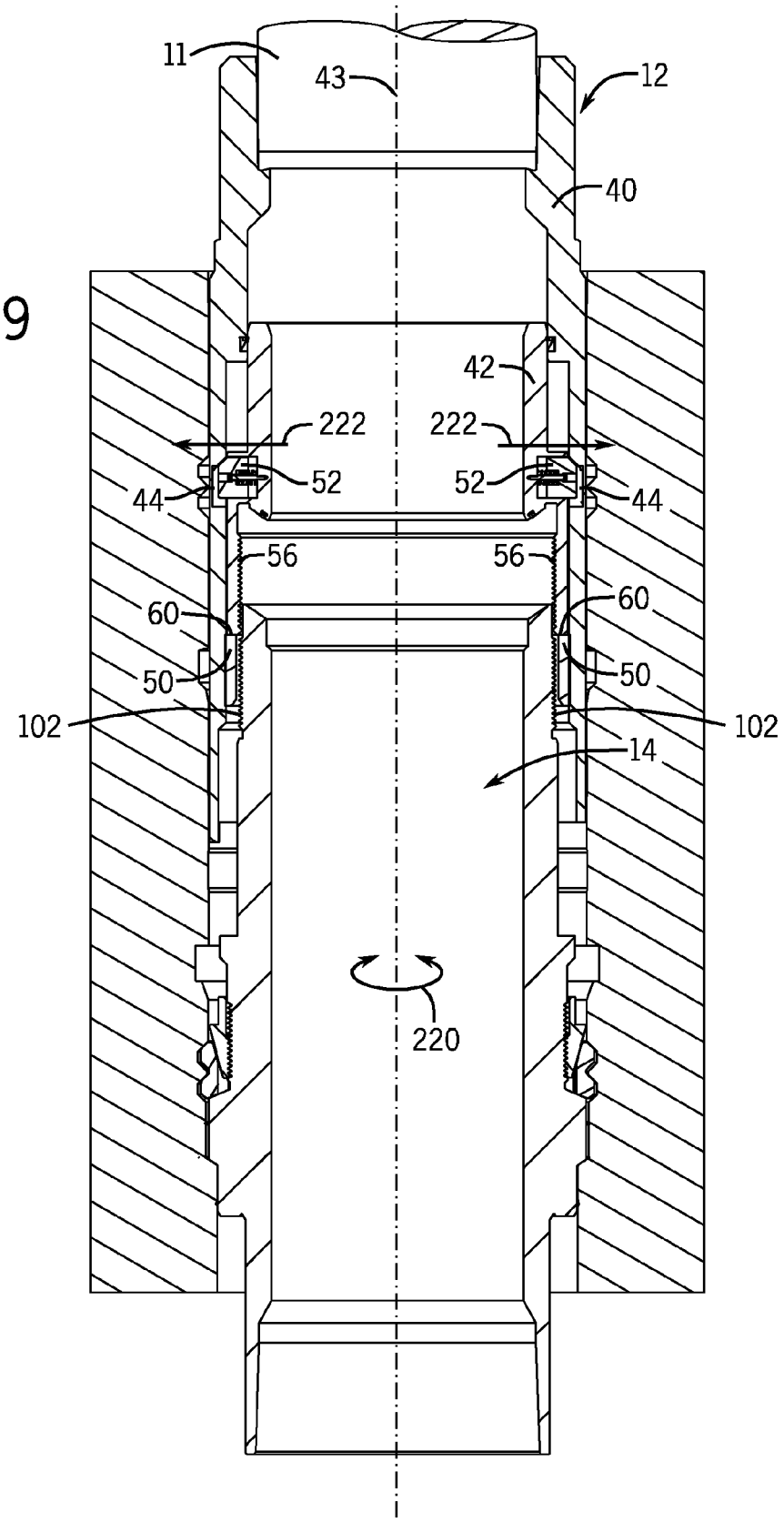
FIG. 9 is a cross-sectional view illustrating the outer sleeve being rotated to engage a set of spring energized dogs from the inner sleeve into spring energized dog pockets in the outer sleeve.

Upon successful completion of the overpull test, the outer sleeve 40 of the casing hanger running tool 12 is configured to drive rotation of the inner sleeve 42 of the casing hanger running tool 12, as illustrated in FIG. 9. As will be described in greater detail with respect to FIGS. 11A and 11B, to enable rotation of the inner sleeve 42 by the outer sleeve 40, the outer sleeve 40 is raised until the spring loaded dog pockets 44 of the outer sleeve 40 have a common axial position (e.g., vertical height) with the spring energized dogs 52 of the inner sleeve 42. For example, in certain embodiments, as the outer sleeve 40 is translated vertically upward (e.g., along axis 43) with respect to the inner sleeve 42, the bearing shoulder 50 of the outer sleeve 40 eventually abuts a lower mating edge 60 of the inner sleeve 42, signifying that the outer sleeve 40 is in a proper vertical alignment (e.g., axial position) for engagement of the spring energized dogs 52 with the spring energized dog pockets 44.

Next, as illustrated by arrow 220, the outer sleeve 40 is rotated slightly about the common longitudinal axis 43 until the spring energized dog pockets 44 of the outer sleeve 40 circumferentially align with respective spring energized dogs 52 of the inner sleeve 42. When aligned vertically and circumferentially, the spring energized dogs 52 of the inner sleeve 42 spring radially outward, or engage, into the spring energized dog pockets 44 of the outer sleeve 40, as illustrated by arrows 222. When the spring energized dogs 52 are engaged with the spring energized dog pockets 44, the outer sleeve 40 drives rotation of the inner sleeve 42. Thus, as the outer sleeve 40 is further rotated about the common longitudinal axis 43, the inner sleeve 42 rotates as well. With the spring energized dogs 52 engaged, the outer sleeve 40 is rotated to unthread the inner sleeve 42 from the casing hanger 14 (e.g., unscrew the threads 56 of the inner sleeve 42 from the threads 102 of the casing hanger 14).

Figure 10:
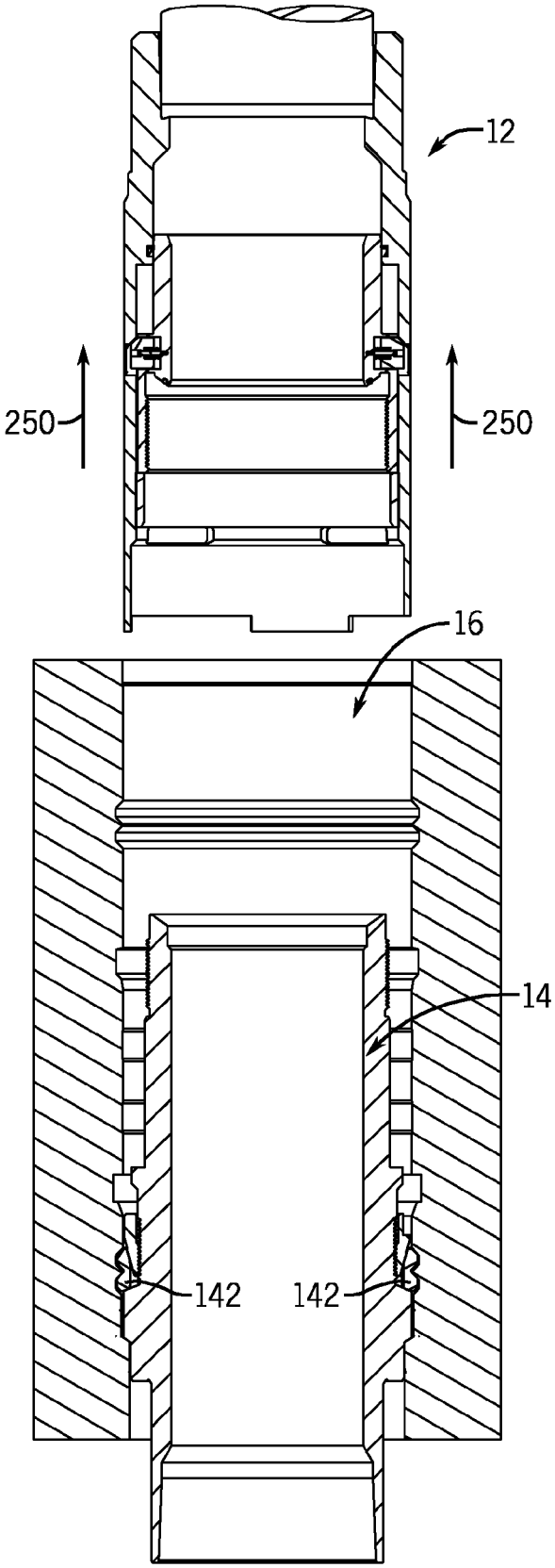
FIG. 10 is an exploded cross-sectional view illustrating the casing hanger running tool decoupled from the casing hanger, in the process of being retrieved.

Once the inner sleeve 42 is unscrewed from the casing hanger 14, the casing hanger running tool 12 may be retrieved, as shown in FIG. 10. As illustrated, the casing hanger 14 is set in the housing 16, locked in place by the set locking ring 142. The casing hanger running tool 12, now de-coupled from the casing hanger 14, is retracted, as illustrated by arrows 250, leaving the set casing hanger 14 locked in place with respect to the casing housing 16.

Figure 11B:
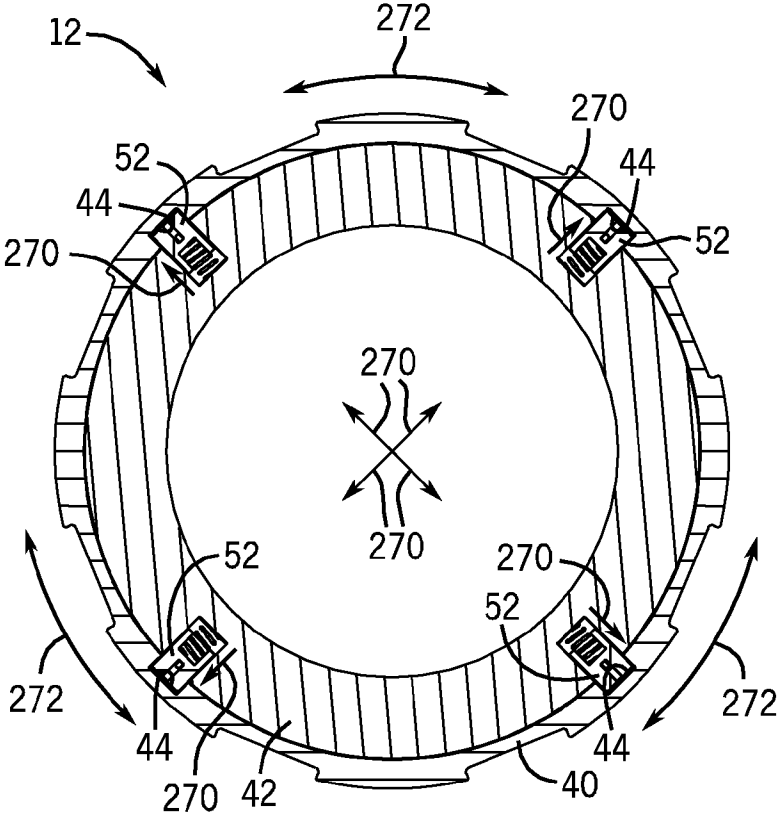
FIGS. 11A and 11B are cross-sectional top views of the casing hanger running tool, illustrating a progression of the spring energized dogs from a disengaged state to an engaged state.
Figure 11A:
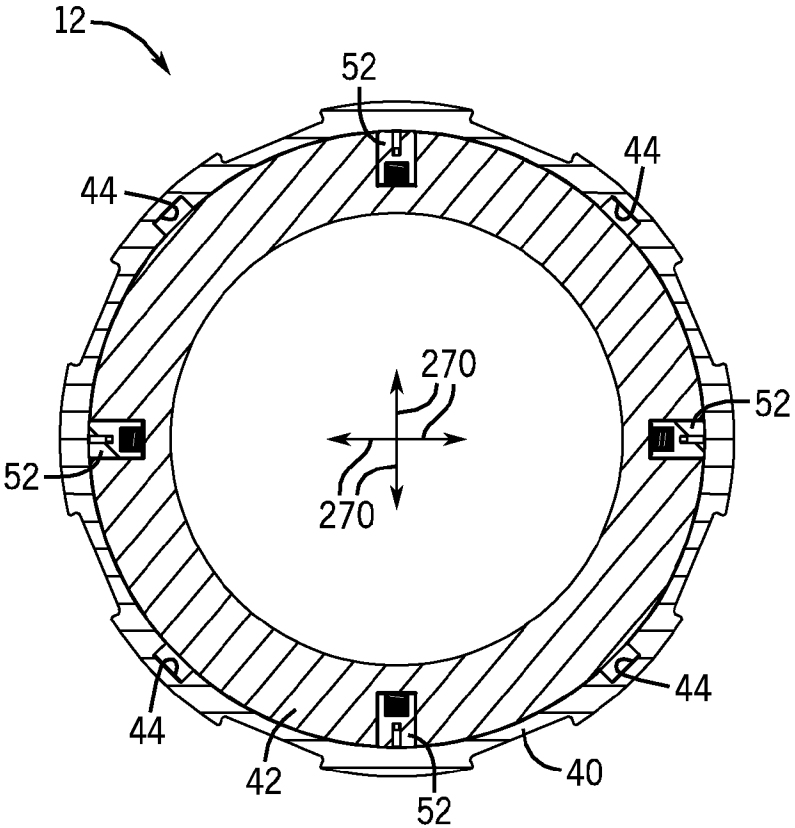

FIGS. 11A and 11B depict cross-sectional top views of the casing hanger running tool 12, illustrating the spring energized dogs 52 of the inner sleeve 42 engaging with the spring energized dog pockets 44 of the outer sleeve 40. In the illustrated embodiment, the outer sleeve 40 comprises four equally circumferentially distributed spring energized dog pockets 44, and thus the inner sleeve 42 comprises four complimentary equally circumferentially distributed spring energized dogs 52. In other embodiments, the spring energized dog pockets 44 and spring energized dogs 52 may not be equally circumferentially distributed. Additionally, there may be fewer or more spring energized dog pockets 44 and spring energized dogs 52 in certain embodiments. For example, in certain embodiments, there may be 1, 2, 3, 5, 6, or more spring energized dog pockets 44 and spring energized dogs 52.

During energizing of the energizing ring 140, the spring energized dogs 52 of the inner sleeve 42 of the casing hanger running tool 12 are not aligned with the spring energized dog pockets 44 of the outer sleeve 40 of the casing hanger running tool 12, as shown in FIG. 11A. Rather, the spring energized dogs 52 are retracted into the inner sleeve 42 and are not affected by circumferential movement of the outer sleeve 40. Once the outer sleeve 40 has been vertically aligned with the inner sleeve 42, the outer sleeve 40 is rotated to align the spring energized dogs 52 of the inner sleeve 42 with the spring energized dog pockets 44 of the outer sleeve 40, as illustrated by arrow 272 in FIG. 11B. Once aligned with the spring energized dog pockets 44, the spring energized dogs 52 spring radially outward, or engage, into the spring energized dog pockets 44, as illustrated by arrows 270. Once engaged, the spring energized dogs 52 cause the inner sleeve 42 to rotate with the outer sleeve 40. More specifically, as the outer sleeve 40 rotates, the forces of the spring energized dog pockets 44 on the spring energized dogs 52 cause the spring energized dogs 52, and thus the inner sleeve 42, to rotate with the outer sleeve 40.

Technical effects of the disclosed embodiments include systems and methods for installing the casing hanger 14 in the casing spool, or housing 16, using a one-run process. The one-run process enhances a multi-trip casing hanger installation process by minimizing the number of trips required and reducing the time between setting the casing hanger 14 and locking the casing hanger 14 to the casing housing 16. Further, the disclosed embodiments enhance a casing hanger installation process where two tools are run at the same time by obviating the need for two rotation systems at the surface. In particular, the casing hanger running tool 12 has outer and inner sleeves 40, 42 that are used to lower the casing hanger 14 into the casing housing 16 as well as to energize the energizing ring 140. The energized energizing ring 140 sets the locking ring 142, which locks the casing hanger 14 to the casing housing 16. Once the casing hanger 14 is properly locked to the casing housing 16, the casing hanger running tool 12 may be retrieved.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system, comprising:

a hanger running tool, comprising:

an inner sleeve having a first mating surface configured to engage a second mating surface of a hanger to couple the inner sleeve to the hanger; and an outer sleeve disposed about the inner sleeve and configured to rotate about a common longitudinal axis with respect to the inner sleeve:

first and second mounting features, wherein the first and second mounting features are configured to selectively engage one another in a first radial direction between the inner and outer sleeves such that rotation of the outer sleeve drives rotation of the inner sleeve when the first mounting feature is engaged with the second mounting feature, wherein the first mounting feature comprises a radial structure and the second mounting feature comprises a radial recess.

2. The system of claim 1, wherein the first mating surface comprises first threads configured to interface with second threads of the second mating surface.

3. The system of claim 1, wherein the radial structure comprises a spring energized dog and the radial recess comprises a dog pocket.

4. The system of claim 1, wherein the radial structure of the first mounting feature comprises one or more spring energized dogs disposed in an exterior surface of the inner sleeve and the radial recess of the second mounting feature comprises one or more spring energized dog pockets disposed on an interior surface of the outer sleeve, and the spring energized dogs are configured to interface with the spring energized dog pockets when the spring energized dogs and the spring energized dog pockets are aligned circumferentially about the common longitudinal axis.

5. The system of claim 1, wherein the outer sleeve comprises a third mating surface disposed on a bottom edge of the outer sleeve, and the third mating surface is configured to mate with a mating surface disposed on a hanger energizing ring.

6. The system of claim 5, wherein the third mating surface comprises outer sleeve castellations configured to mate with energizing ring castellations of the hanger energizing ring.

7. The system of claim 1, wherein the outer sleeve is configured to move axially along the common longitudinal axis with respect to the inner sleeve.

8. The system of claim 7, wherein the outer sleeve comprises a bearing shoulder configured to abut a lower mating edge of the inner sleeve when the outer sleeve is in a maximum vertical position with respect to the inner sleeve.

9. The system of claim 1, wherein the outer sleeve is configured to move axially along the common longitudinal axis with respect to the inner sleeve, the outer sleeve comprises a bearing shoulder configured to abut a lower mating edge of the inner sleeve when the outer sleeve is in a maximum axial position with respect to the inner sleeve, and the first and second mounting features are at a common axial position when the bearing shoulder and lower mating edge abut.

10. The system of claim 1, wherein the hanger running tool is configured to enable axial translation between the inner and outer sleeves when the first mounting feature of the inner sleeve is selectively disengaged from the second mounting feature of the outer sleeve.

11. The system of claim 10, wherein the hanger running tool is configured to axially translate the outer sleeve relative to the inner sleeve until the outer sleeve rotationally couples to an energizing ring, and the hanger running tool is configured to rotate the outer sleeve to drive rotation and axial movement of the energizing ring to actuate a locking ring to lock the hanger to a housing.

12. A method for running a hanger running tool, comprising:

attaching an inner sleeve of a hanger running tool to a hanger;

lowering the hanger into a housing utilizing the hanger running tool;

selectively disengaging a first mounting feature from a second mounting feature in a first radial direction between the inner sleeve and an outer sleeve of the hanger running tool to change from blocking to enabling rotation between the inner and outer sleeves, wherein the first mounting feature comprises a radial structure and the second mounting feature comprises a radial recess;

locking the hanger to the housing via the hanger running tool by energizing an energizing ring via rotation of the outer sleeve of the hanger running tool about a common longitudinal axis with respect to the inner sleeve of the hanger running tool;

detaching the hanger from the inner sleeve of the hanger running tool; and retrieving the hanger running tool.

13. The method of claim 12, wherein attaching the inner sleeve to the hanger comprises screwing a threaded mating surface of the hanger to a complimentary threaded mating surface of the hanger running tool; and wherein detaching the hanger from the inner sleeve comprises unscrewing the threaded mating surface of the hanger from the complimentary threaded mating surface of the hanger running tool.

14. The method of claim 12, wherein locking the hanger to the housing via the hanger running tool comprises:

engaging outer sleeve castellations disposed on the outer sleeve of the hanger running tool into castellations of the energizing ring; and rotating the outer sleeve about the common longitudinal axis with respect to the inner sleeve to cause axial movement of the energizing ring in a first axial direction, wherein the axial movement of the energizing ring in the first axial direction causes a locking ring to expand radially outward and lock into position with respect to the housing.

15. The method of claim 14, wherein detaching the hanger from the inner sleeve of the hanger running tool comprises:

disengaging the outer sleeve castellations from the castellations of the energizing ring;

axially moving the outer sleeve in a second axial direction with respect to the inner sleeve until the first mounting feature of the inner sleeve is at a common axial position as the second mounting feature of the outer sleeve;

rotating the outer sleeve until the first mounting feature of the inner sleeve engages the second mounting feature of the outer sleeve, such that rotation of the outer sleeve causes rotation of the inner sleeve; and detaching the hanger from the inner sleeve of the hanger running tool by rotating the outer sleeve and the inner sleeve.

16. The method of claim 12, comprising applying an axial force within the hanger subsequent to locking the hanger into the housing to ensure that the hanger is locked in place relative to the housing.

17. The method of claim 12, wherein lowering the hanger into the housing utilizing the hanger running tool comprises:

detecting when the hanger lands on a landing shoulder of the housing; and halting the lowering of the hanger upon such detection.

18. The method of claim 12, wherein:

selectively engaging the first mounting feature with the second mounting feature in a second radial direction between the inner sleeve and the outer sleeve such that the inner and outer sleeves are rotationally coupled together when rotationally attaching the inner sleeve of the hanger running tool to the hanger; and selectively engaging the first mounting feature with the second mounting feature in the second radial direction between the inner sleeve and the outer sleeve such that the inner and outer sleeves are rotationally coupled together when rotationally detaching the hanger from the inner sleeve of the hanger running tool.

19. The method of claim 12, comprising operating the hanger running tool to enable axial translation between the inner and outer sleeves.

20. The method of claim 19, comprising axially translating the outer sleeve relative to the inner sleeve until the outer sleeve rotationally couples to the energizing ring, and rotating the outer sleeve to drive rotation and axial movement of the energizing ring to actuate a locking ring to lock the hanger to the housing.

21. The method of claim 12, wherein the radial structure comprises a spring energized dog and the radial recess comprises a dog pocket.

22. A system, comprising:

a hanger running tool, comprising:

an inner sleeve having a first mating surface configured to engage a second mating surface of a hanger to couple the inner sleeve to the hanger; and an outer sleeve disposed about the inner sleeve and configured to rotate about a common longitudinal axis with respect to the inner sleeve;

wherein the outer sleeve comprises a third mating surface disposed on a bottom edge of the outer sleeve, and the third mating surface is configured to mate with a mating surface disposed on a hanger energizing ring; and first and second mounting features configured to selectively engage one another in a first radial direction to rotationally couple the inner and outer sleeves, wherein the first and second mounting features are configured to selectively disengage one another in a second radial direction to rotationally uncouple the inner and outer sleeves, and the first mounting feature comprises a radial structure and the second mounting feature comprises a radial recess.

23. A system, comprising:

a hanger running tool, comprising:

a first sleeve comprising a first mounting feature having a radial structure; and a second sleeve comprising a second mounting feature having a radial recess, wherein the first and second sleeves are concentric with one another, the first and second mounting features are configured to selectively engage in a first radial direction into a locked position or selectively disengage in a second radial direction into an unlocked position, the first and second sleeves are configured to rotate together while in the locked position, the first and second sleeves are configured to axially slide relative to one another along an axial path of travel between a first axial position and a second axial position while in the unlocked position, and the first and second sleeves are configured to rotate relative to one another at the second axial position while in the unlocked position.

24. The system of claim 23, wherein the first and second mounting features are configured to selectively engage in the first radial direction into the locked position or selectively disengage in the second radial direction into the unlocked position at the first axial position.

25. The system of claim 23, wherein the first and second sleeves are configured to rotate together while in the locked position to selectively engage a rotational coupling or selectively disengage the rotational coupling between the first sleeve and a hanger.

26. The system of claim 25, wherein the rotational coupling comprises threads.

27. The system of claim 23, wherein, at the second axial position while in the unlocked position, the second sleeve is configured to rotate relative to the first sleeve to selectively rotate an energizing ring along threads to actuate a locking ring in a radial direction to lock a hanger to a housing.

* * * * *